US005411516A

United States Patent [19]

Thomas

[11] Patent Number: 5,411,516

[45] **Date of Patent: * May 2, 1995**

[54] EAR PIERCING DEVICE AND METHOD

[76] Inventor: Stephen P. Thomas, 17615 100th Ave., SW., P.O. Box 1726, Vashon, Wash. 98070

[ * ] Notice: The portion of the term of this patent subsequent to Sep. 2, 2010 has been disclaimed.

[21] Appl. No.: 888,010

[22] Filed: May 26, 1992

[51] Int. Cl.[6] ..... A61B 17/34

[52] U.S. Cl. ..... 606/188; 63/12

[58] Field of Search ..... 606/184–189; 63/12, 13; 227/68; 40/300, 301

[56] References Cited

U.S. PATENT DOCUMENTS

| | | | |
|---|---|---|---|
| 3,500,829 | 3/1970 | Abramowitz | 606/188 |
| 3,527,223 | 9/1970 | Shein | 606/188 |
| 3,789,850 | 2/1974 | Ford | 606/188 |
| 4,781,036 | 11/1988 | Erickson | 606/188 |
| 5,076,072 | 12/1991 | Payne | 63/12 |

*Primary Examiner*—Stephen C. Pellegrino

*Assistant Examiner*—William Lewis

[57] ABSTRACT

A method and kit is provided for piercing an ear while allowing conventional earring posts to be interchangeably inserted into and withdrawn from the pierced ear throughout the ear healing process. The kit includes a conventional ear piercing gun with a slightly stronger spring for shooting a plunger toward an ear. A two part piercing stud or post includes a hollow post through which a solid post is inserted. A rubber plug is mounted within the hollow post for frictionally retaining the solid post during the ear piercing process and for frictionally retaining a conventional earring post during the ear healing process. The method for piercing the post includes loading the two part piercing post onto the plunger of the gun, and loading an earring back on an opposite support of the gun. The gun is then positioned upon the ear, and the piercing post is shot through the ear and into the earring back. The gun is then removed from the piercing post and the solid post may be removed from the hollow post and interchanged with any conventional earring post.

8 Claims, 2 Drawing Sheets

EAR PIERCING DEVICE AND METHOD

BACKGROUND OF THE INVENTION

The present invention relates to a method and kit for piercing ear lobes, and in particular, to piercing ear lobes with a protective, piercing stud, shot into the lobe by a conventional ear piercing gun.

The primary disadvantage with the current devices used for ear lobe piercing is that conventional ear piercing devices insert a standard piercing stud into the ear lobe. The conventional piercing stud is worn for four to six weeks until the hole created in the ear lobe heals and there is no longer the risk of infection. The standard piercing stud includes a plain and ordinary head which is considered unattractive by most women and men getting their ears pierced.

Two U.S. Pat Nos. 5,007,918 and 5,004,471 to Mann, attempt to address this problem by including piercing studs with an ornamental head or by having interchangeable ornamental heads. However, although U.S. Pat. No. 5,004,471 to Mann is an ornamental head, it allows wearers only one choice for the six-week period. And with U.S. Pat. No. 5,007,918 to Mann it can be difficult to interchange the heads and it is expensive, since the interchangeable ornamental heads are temporary and will not be used after the six-week healing period.

Other prior art regarding ear piercing devices does not address this problem and, in addition, presents other disadvantages.

U.S. Pat. No. 4,020,848 to DiCicco is indicative of the conventional ear piercing apparatus. Although it is used in conjunction with the standard ear lobe piercing gun, the DiCicco device inserts a conventional, nondecorative stud into the ear lobe, which must remain in the ear for four to six weeks.

U.S. Pat. No. 3,831,597 to Shiller is indicative of the ear piercing devices that are not used in conjunction with the conventional ear piercing guns. Shiller, instead, requires manual insertion of the pointed end of a piercing post into the ear lobe. While the piercing post is hollow, allowing for the immediate insertion of a decorative earring, the hollow post does not stay in the ear, but is removed, which causes further irritation of the hole in the ear lobe. Because Shiller requires manual insertion of the pointed piercing post through the ear instead of the conventional gun, it is not likely to be used to pierce ears by physicians in their offices or by non-medical technicians in jewelry stores.

U.S. Pat. No. 3,527,223 to Shein is not designed to use a conventional piercing gun, but requires that the piercing post be pushed through the ear manually. Although the piercing post is hollow, allowing an earring to be inserted through the hollow hole, the piercing post is removed after the earring is inserted. This second step required by Shein creates unnecessary irritation of the sensitive tissue around the new opening in the ear lobe. Secondly, Shein's piercing post is hollow all the way to the tip, so it does not give a solid piercing tip to facilitate efficient and sanitary piercing of the earlobe.

U.S. Pat. No. 4,274,416 to Sorensen does not deal with piercing the earlobe, but with guiding ear rings into the hole in the earlobe after the hole has healed.

U.S. Pat. No. 4,067,341 to Ivey does not deal with piercing the earlobe, but with protecting the earlobe hole after it has healed.

SUMMARY OF THE INVENTION

It is an object of this invention to provide a piercing earring that remains in the ear lobe after piercing, but that allows interchangable ornamention earrings that can be worn immediately, rather than waiting the average six to eight weeks with a conventional piercing post in the ear.

Another object of the invention is to provide a method of ear piercing that can be used in conjunction with the conventional ear piercing gun.

It is a further object of the invention to provide a safe and sanitary method for piercing the earlobe that doesn't require unneccessary irritation of the tissue because of removing or inserting posts into the hole after piercing.

Other objects of the invention will be apparent hereinafter from the specification and from the recital of the appended claims, particularly when read in conjunction with the accompanying drawings.

The present invention involves using a hollow piercing post in conjunction with a solid carry-through post to pierce the earlobe. The solid carry-through post is inserted into the hollow piercing post and the two pieces together form a solid, sharp piercing point at the tip. The rubber plug in the back housing body of the piercing post holds the carry-through post securely in place.

The assembled piercing apparatus is then mounted onto the plunger of a conventional piercing gun. The gun is positioned onto the earlobe and, when the operator pulls the trigger, the plunger pushes the piercing post through the earlobe and the earring back positioned on the other side of the gun. The operator then carefully pulls the carry-through post out of the piercing post, leaving the hollow piercing post securely in the freshly made hole. An ornamental earring post can now be placed in the hollow piercing post. A frictional rubber plug in the housing body holds the ornamental earring securely in place. Earrings can be changed as often as desired with no irritation to the tissue surrounding the earlobe hole, because the hollow piercing post remains in the ear for the average four to six weeks, and then is removed.

DETAILED DESCRIPTION OF THE INVENTION

Figure 1:
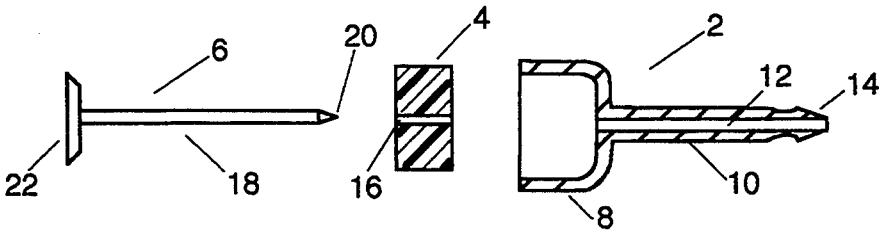
FIG. 1 shows a disassembled, exploded cross-section of the earlobe piercing device and the present invention.

FIG. 1 shows the parts of the complete ear piercing device of the present invention including the hollow post 2, the cylindrical rubber plug 4, and a solid carry-through post 6. The hollow post includes an enlarged plug housing 8, a hollow shaft 10, and a central bore 12 extending from the beveled end 14 through the hollow shaft and ending at the enlarged plug housing. The rubber plug 4 is cylindrical in shape and includes a central bore 16 therethrough. The central bore of the rubber plug is smaller than the hole of the central bore 12. The carry-through post has a solid shaft 18 ending in a sharp point 20 with a fiat head 22 opposite the sharp point.

Figure 2:
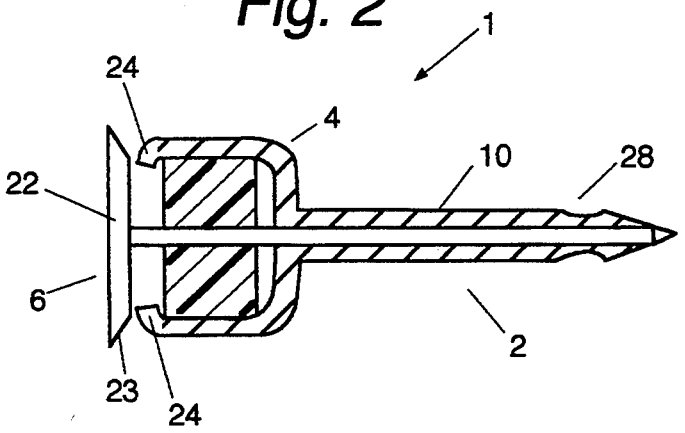
FIG. 2 shows an assembled cross-section of the earlobe piercing device of FIG. 1.

FIG. 2 shows the parts assembled into the ear piercing device 1 of the present invention. The plug fits into the housing body 8. The lip 24 of the housing body is crimped down over the plug to retain the plug within the post. The pointed end of the carry-through post 6 is inserted in the central bore of the plug. The solid shaft of the carry-through post expands the central bore of the rubber plug. The carry-through post is inserted all the way through the hollow post with the point 20 ending at the beveled end 14 of the hollow post. The fiat head 22 of the solid carry through post includes a bevelled surface 23 on the inside surface of the head to allow the carry through post to be easily grasped by a person's fingers to insert and/or remove the solid post from the hollow post 2. Near the end of the hollow shaft 10 is a depression 28 that interacts with the earring back after it is shot through the hollow shaft.

Figure 3:
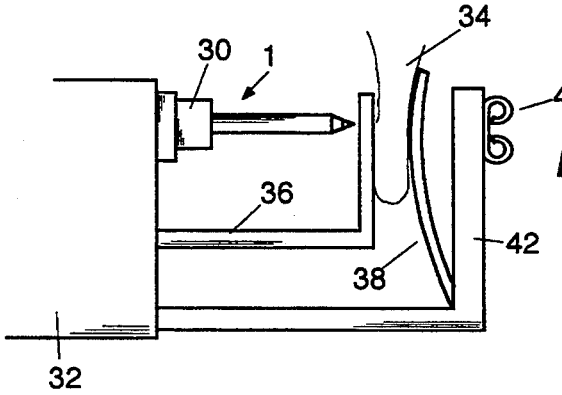
FIG. 3 shows a view of the device loaded onto a conventional gun with the earlobe in position.

Operation of the piercing device of the present invention will be explained in conjunction with FIGS. 3–7. FIG. 3 shows the load view in the operation of the earpiercing device. The assembled piercing post 1 is positioned on the plunger 30 of a conventional ear piercing gun 32. The earlobe 34 is positioned between the U-shaped ear support 36 and the U-shaped leaf spring 38 of the earpiercing gun. The eating back 40 is positioned on the eating back's support 42.

Figure 4:
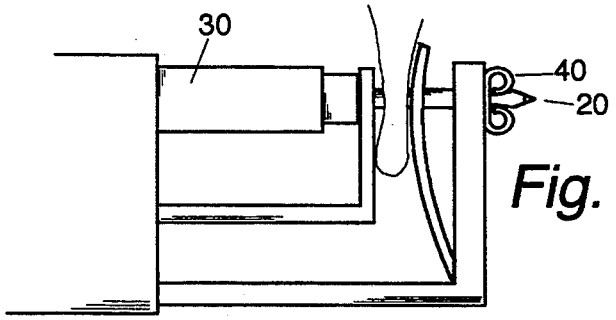
FIG. 4 shows the piercing point of the present invention shot through the earlobe.

FIG. 4 shows the shot view in the operation of the earpiercing device. The operator of the gun pulls the trigger and the plunger 30 is shot forward by a spring within the gun shooting. Because the piercing post 1 of the present invention is thicker than a conventional piercing post, the conventional spring within the piercing gun needs to be replaced with a stronger spring when used in conjunction with the present invention. The plunger pushes the assembled piercing point 20 through the earlobe to the earring back 40 positioned in the earring back support of the gun. The earring back 40 may also be made of a stronger construction than conventional earring backs to work better with the thicker post. In addition to forming a point 20 to pierce the ear with, the solid carry through post also serves the additional purpose of strengthening the hollow post 2 which might otherwise might be susceptible to a crushing or bending force prior to or during the piercing process. When the solid post 6 is disposed within the hollow post 2 to form the piercing post 1, the piercing post becomes a singular solid post that is much stronger than merely a hollow post.

Figure 5:
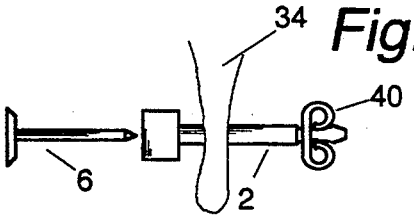
FIG. 5 shows the carry-through post removed from the hollow piercing post.

FIG. 5 shows the removal of the carry-through post 6 from the central bore of the hollow piercing post 2. The carry-though post had been held securely in place by the frictional rubber plug 4.

Figure 6:
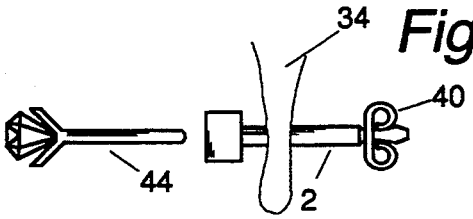
FIG. 6 shows an ornamental earring positioned to be placed through the hollow piercing point.

FIG. 6 shows the shaft of a conventional ornamental earring post 44 positioned to be inserted into the central bore of the hollow piercing post.

Figure 7:
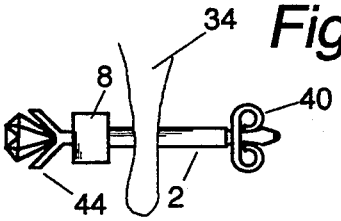
FIG. 7 shows an ornamental earring held securely in position inside of the hollow piercing point.

FIG. 7 shows the conventional ornamental earring inserted through the central bore of the hollow post of the present invention. The end 46 of the conventional earring extrudes from the hollow end of the piercing post and is held firmly in place by the frictional rubber plug 4 inside the enlarged plug housing 8. The earring back 40 holds the piercing post securely in position.

The present invention may be used and is unique even without the solid carry through post 6. The hollow post 2 with its bevelled end 14 may be used to pierce the ear directly without the solid post. In this case, the plug 4 for frictionally retaining a conventional earring post would still be used with the singular hollow post and provide a safe way of retaining the hollow post upon a person's ear. The plug housing 8 has additional utility in that it provides an easily graspable surface on the hollow post. This is important because a person is usually instructed to turn the post within the newly pierced ear, on a regular basis, to assist the ear in its healing process.

The description, above, deals primarily with the piercing of an ear. However, people commonly have other parts of the body pierced, including their nose. It should be appreciated that the present invention would work for the piercing of any body part.

It should be apparent that many modifications could be made to the ear piercing device and method which would still be encompassed within the spirit of the present invention. It is intended that all such modifications may fall within the scope of the appended claims.

What is claimed is:

1. A method for piercing a body part of a person, comprising:

a first step of inserting a solid post having a piercing point through a hollow post to form a piercing post;

a second step of loading said piercing post within a plunger of a piercing gun;

a third step of positioning said piercing gun around the body pan, said piercing point of said piercing post positioned adjacent a predetermined point upon the body part;

a fourth step of shooting said piercing post through the body pan at the predetermined point;

a fifth step of removing said gun from said piercing post;

a sixth step of removing said solid post from said hollow post;

wherein, said hollow post remains within the body part during the entire healing process and allows conventional earring posts to be interchangeably inserted into and withdrawn from said hollow post during the healing process.

2. A method for piercing a person's body part, as claimed in claim 1, wherein, said second step comprises a sub-step of loading an earring back within said piercing gun, and said fourth step further comprises shooting said piercing post through said earring back.

3. A method for piercing a person's body part, as claimed in claim 1, wherein, said method further comprising a seventh step of inserting a conventional earring post through said hollow post.

4. A method for piercing a person's body part, as claimed in claim 3, wherein, said seventh step further comprises a sub-step of frictionally securing said conventional post within said hollow post.

5. A kit for piercing a body part of a person, comprising:

a piercing gun having a means for holding the body part steady relative to said gun, a support for supporting an earring back adjacent the body part, and a plunger for shooting a post through the body part;

a hollow post capable of being loaded within said plunger of said piercing gun;

a solid post inserted through said hollow post, said solid post having a sharp piercing point to pierce the body part when said plunger shoots said hollow post through the body part;

a means for frictionally retaining a conventional earring post within said hollow post once said solid post is removed from said hollow post;

wherein, said kit allows a body part to be pierced by placing said hollow post within the pierced body part which provides a means for allowing any conventional earring post to be worn during the healing process.

6. A kit for piercing a person's body part, as claimed in claim 5, wherein, said kit further comprising an earring back supported by said piercing gun support prior to the body part being pierced, and for holding and retaining said hollow post after completion of the piercing process.

7. A kit for piercing a person's body part, as claimed in claim 5, wherein, said means for frictionally retaining said conventional post within said hollow post comprises a plug mounted within said hollow post, said plug having a hole therethrough of a diameter of less than the diameter of said conventional post, said plug further having a flexible means for expanding said hole to allow said conventional post to be inserted through said hole and frictionally hold said conventional post within said hole.

8. A kit for piercing a body part of a person, comprising:.

a piercing gun having a means for holding the body part steady relative to said gun, a support for supporting an earring back adjacent the body part, and a plunger for shooting a post through the body part;

a hollow post capable of being loaded within said plunger of said piercing gun, said hollow post having a plug disposed within a plug housing;

said plug comprising means for frictionally retaining a conventional earring post within said hollow post once the body part has been pierced;

wherein, said kit allows a body part to be pierced by placing said hollow post within the pierced body part which provides a means for allowing any conventional earring post to be worn during the healing process.

* * * * *